US007563969B2

(12) United States Patent
Einhorn et al.

(10) Patent No.: US 7,563,969 B2
(45) Date of Patent: Jul. 21, 2009

(54) CAPO FOR A STRINGED INSTRUMENT

(75) Inventors: Peter J. Einhorn, Woodstock, NY (US); Frederic W. Hand, Woodstock, NY (US)

(73) Assignee: Creative Tunings, Inc., Woodstock, NY (US)

( * ) Notice: Subject to any disclaimer, the term of this patent is extended or adjusted under 35 U.S.C. 154(b) by 554 days.

(21) Appl. No.: 10/964,006

(22) Filed: Oct. 7, 2004

(65) Prior Publication Data

US 2005/0257661 A1 Nov. 24, 2005

Related U.S. Application Data

(60) Provisional application No. 60/573,628, filed on May 24, 2004.

(51) Int. Cl.
*G10D 3/16* (2006.01)

(52) U.S. Cl. ..... 84/318

(58) Field of Classification Search ..... 84/315–318
See application file for complete search history.

(56) References Cited

U.S. PATENT DOCUMENTS

| | | | | | |
|---|---|---|---|---|---|
| 468,193 | A | | 2/1892 | Dahlman et al. | |
| 514,263 | A | | 2/1894 | Filstrup | |
| 2,961,913 | A | | 11/1960 | Popkin | |
| 3,011,380 | A | | 12/1961 | Brimhall | |
| 3,680,427 | A | * | 8/1972 | Valentino | 84/456 |
| 3,818,793 | A | * | 6/1974 | Round | 84/454 |
| 3,915,051 | A | * | 10/1975 | Kincaid | 84/317 |
| 3,995,523 | A | | 12/1976 | Clarke | |
| 4,183,279 | A | | 1/1980 | Shabram, Jr. | |
| 4,195,546 | A | | 4/1980 | Urbank | |
| 4,334,457 | A | * | 6/1982 | Spoonts, III | 84/318 |
| 4,503,747 | A | | 3/1985 | Labbé | |

(Continued)

OTHER PUBLICATIONS

Suttle, Cliff, New Stuff From NAMM for Guitar Players and Collectors, "Harmony Central" Web Page Article Winter NAMM 1999. http://www.harmony-central.com/Events/WNAMM99/Guitar_Goodies.

(Continued)

*Primary Examiner*—Briggitte R Hammond
(74) *Attorney, Agent, or Firm*—Bergman & Song LLP

(57) ABSTRACT

A capo for a stringed instrument includes a first jaw member and a second jaw member with respective first and second jaw surfaces. A tightening mechanism is disposed on the first jaw mechanism, and is adapted to place a lateral member in tension between the first and second jaw members. The tension on the lateral member urges the first and second jaw members of the capo inward towards a neck of a stringed instrument, such that the capo is removably but stably supported by the neck of the instrument. The lateral member is disposed in spaced relation above a fingerboard of the instrument. The lateral member supports one or more string contacting members that serve to adjustably urge respective instrument strings toward the fingerboard, thereby changing the tuning of the instrument. Friction between the first and second jaw surfaces and the neck of the instrument serves to oppose a force between the string contacting member and the string, such that the string may be urged towards the fingerboard without a further member traversing a rear surface of the instrument neck.

13 Claims, 18 Drawing Sheets

U.S. PATENT DOCUMENTS

| | | | | | |
|---|---|---|---|---|---|
| 4,621,558 | A | | 11/1986 | Cornette | |
| 4,671,156 | A | * | 6/1987 | Hathcock | 84/318 |
| 4,926,732 | A | * | 5/1990 | Collins et al. | 84/318 |
| 5,101,706 | A | | 4/1992 | Kilgore | |
| 5,117,723 | A | | 6/1992 | Veenschoten | |
| 5,373,770 | A | * | 12/1994 | Dudley | 84/318 |
| 5,431,080 | A | | 7/1995 | Wiesenthal | |
| 5,623,110 | A | * | 4/1997 | Hoglund et al. | 84/318 |
| 6,459,025 | B1 | | 10/2002 | D'Addario | |
| 6,521,820 | B1 | | 2/2003 | Patel | |
| 6,528,711 | B1 | | 3/2003 | Paige | |
| 6,573,440 | B1 | | 6/2003 | Rodriguez | |
| 6,635,813 | B2 | | 10/2003 | Campling | |

OTHER PUBLICATIONS

Woodies UK Ltd. Reviews, Web Page Article. Nov. 2001. http://www.woodiesuk.moonfruit.com.

H. Reid, "The History of the Partial Capo," Third Hand Capo, www.thirdhandcapo.com/history.html, 5 pages, Jun. 1996.

* cited by examiner

CAPO FOR A STRINGED INSTRUMENT

CROSS REFERENCE TO RELATED APPLICATIONS

The present application claims the benefit of U.S. provisional patent application No. 60/573,628 entitled Capo for a Stringed Instrument filed May 24, 2004, the disclosure of which is herewith incorporated in its entirety.

FIELD OF THE INVENTION

The present invention relates to stringed instruments, and more particularly to apparatus and methods for controlling the strings thereof.

BACKGROUND OF THE INVENTION

Musicians have played stringed instruments for millennia. The lute and the lyre have been known for at least four thousand years. Despite this longevity, significant innovation in the apparatus and techniques of stringed instrument technology continues to be made. If anything, the pace of such change is increasing, such that much of the music now produced with stringed instruments would have been completely alien to the musicians and composers of only a century ago. The opportunity clearly exists for significant further innovation.

Stringed instruments include an elongate elastic member, or string, disposed in tension between respective pairs of fixed string ends. Energy is stored in the string by, for example, bowing, hammering or plucking the string. The stored energy is then released by oscillatory motion of the string. The release of energy takes place both directly to surrounding air displaced by the moving string, and indirectly as the momentum of the string is transferred to a soundboard through a bridge. Often a resonant chamber is attached to the soundboard. The structure of the resonant chamber, and the air therewithin, oscillates in resonance with the vibrating string to produce relatively louder tones and various harmonics.

In other stringed instruments, a sensor, called a pickup, detects the motion of the string with respect to the pickup. This detection may include sensing a perturbation in a magnetic or electric field related to string motion. Typically, the pickup produces an electrical output signal related to the oscillatory motion of the string. The electrical signal is usually amplified by a system including an active electronic component, such as a transistor or a vacuum tube, to produce an amplified electronic signal. The amplified electronic signal may, in turn, be used to control an output transducer that produces audible signals in a surrounding medium, most commonly air. Common examples of output transducers include speakers and headphones. The amplified electronic signal may also be used to control an analog or digital recording device, such as a magnetic tape system so that the oscillatory pattern produced by the string may be reproduced at a later time.

The oscillatory motion of a string depends on such factors as the length of the string, the weight of the string, its diameter, it elasticity, and the tension under which it is placed. Additional factors include the characteristics of the medium surrounding the string, and the mechanisms by which the ends of the string are secured. Also significant are the structure and characteristics of any bridge, soundboard, pickup, etc. with which the string interfaces. During operation of an instrument these characteristics and factors may be substantially invariant, or may vary in intended and unintended ways.

In particular, many stringed instruments are controlled by varying effective string length and tension and by manipulation of one or more strings.

Many instruments, such as the lute, the guitar, the violin, the viola, and the string base include a fingerboard. The fingerboard is typically made of wood and includes an elongate upper surface above which a plurality of strings is stretched taught. Some instruments have a plurality of frets disposed on the upper surface of the fingerboard in substantially perpendicular relation to the taught strings. An individual playing such an instrument activates one or more of the strings using one hand, and uses the digits of a second hand to urge selected strings towards the fingerboard. The string comes in contact with one of the frets and/or the fingerboard, and this point of contact defines an effective length of the string with respect to the second end. The effective length of the string is dynamically varied by moving the fingers of the second hand to produce varying tones as music is played. Depending on the skill of the player and the characteristics of the instrument, highly complex and rapidly varying combinations of tones may be produced.

Musicians have a variety of techniques for applying the fingers of the second hand to the strings and urging the strings towards the finger board. In some of these techniques, pressure is applied to a rear surface of the neck of the instrument using a thumb of the second hand. The pressure applied by the thumb operates in a direction opposite to that applied by the fingers so that the strings and neck of the instrument are pinched together between thumb and fingers. As the instrument is played, the second hand is moved longitudinally up and down the neck of the instrument while the aforementioned forces are serially applied and released. During this motion, the thumb may remain in contact with the rear surface of the neck, sliding across that surface and aiding in the rapid and precise positioning of the second hand.

Activating a string produces a note. A musical chord is produced when a plurality of strings of an instrument are activated at a particular time to produce a corresponding plurality of notes. The chord is the combination of notes resulting when the plurality of notes are played together.

The characteristics of music produced by the player of such an instrument are limited by the player's ability to apply and release his or her fingers in relation to the strings and fingerboard. In particular, the maximum distance, or span, between a player's extended fingers limits the respective points at which multiple strings may be simultaneously depressed, and hence limits the chords and sequences of notes that may be produced.

It is known in the art to apply a device called a capodastro or capo, to an instrument in order to modify the effective length of one or more strings of the instrument without applying finger pressure to those strings (i.e. when the strings are open). Generally speaking, a capo includes a detent device that temporarily urges the strings towards the fingerboard, so that an effective length of the string is defined by a pinch point between the capo and the fingerboard, or at a fret over which the string is drawn, by application of the capo.

U.S. Pat. No. 468,193 to Dahlman et al. (the disclosure of which is herewith incorporated by reference in its entirety) describes a capo for application to stringed instruments such as guitars, violins, etc. The Dahlman capo includes a plate with a cushion at its underside, the cushion being adapted to engage the strings of an instrument, and depress the strings firmly in place on top of the neck so as to raise the tone of the instrument. The plate extends transversely across the neck of the instrument and has at its middle a lug, pivotally connected to a yoke that extends transversely on one side of the neck to reach with a lower arm under the neck. The lower arm has a cushion that pivotally engages an underside of the neck such that the strings are clamped in place on the neck. This clamping is effected by a V-shaped spring connected with a hand lever.

U.S. Pat. No. 5,117,723 to Venschoten (the disclosure of which is herewith incorporated by reference in its entirety) shows a further capo having a cushioned top pressure bar adapted to engage the strings of an instrument, and a brace or lever adapted to pivotally engage the neck of the instrument. According to Venschoten this pivotal engagement is effected by a worm gear arrangement.

U.S. Pat. No. 6,573,440 to Rodriguez and U.S. Pat. No. 6,528,711 to Paige (the disclosures of which are herewith incorporated by reference in their entirety) show respective capos in which clamping is effected by the compression and torsion of a coil spring respectively.

Various prior art capos have the capacity to clamp particular strings of an instrument selectively, without simultaneously contacting all strings of the instrument. Such capos are shown in U.S. Pat. No. 3,011,380 to Brimhall, U.S. Pat. No. 3,680,427 to Valentino, U.S. Pat. No. 4,183,279 to Shabram Jr., U.S. Pat. No. 4,334,457 to Spoonts III U.S. Pat. No. 5,623,110 to Hogland et al. and U.S. Pat. No. 6,521,820 to Patel. Each of these is herewith incorporated by reference in its entirety. As in the foregoing references, each of these references shows a capo in which a member applied to a rear surface of an instrument neck urges a further member, and therefore a string of the instrument against an opposite face of the instrument neck.

In the case of the Patel and Hogland references, the respective capo is applied by pivotally actuating a pair of handles that protrude away from the instrument neck in substantially perpendicular relation to the longitudinal axis of the neck.

In use, the protruding handles of the Patel and Hogland capos may interfere with the motion, with respect to the instrument neck, of the musician's second hand. This interference may make the playing of some notes and chords difficult or impossible. It may also reduce the rapidity with which playable notes and chords may be produced.

Similar interference may also result in the case of other prior art capos where, for example, a retaining bar or strap extends transversely across the rear surface of the instrument neck. In view of these and other limitations, it is believed that an opportunity exists to advance the state-of-the-art.

SUMMARY OF THE INVENTION

The present invention overcomes the problems associated with the prior art and provides a method and apparatus for controlling the strings of a stringed instrument. The invention allows a musician to play in alternate tunings without detuning the pitches of the strings by turning the tuning pegs. It allows for the mechanical depression of each individual string or any combination of strings, along the length of a neck of a stringed instrument.

The present invention includes a method and apparatus for independently clamping one or more strings of an instrument in a highly stable but rapidly changeable configuration. In one aspect, a capo according to the invention effects string clamping while offering little interference to the second hand of a musician playing the instrument. According to one embodiment, the capo couples to the side of a neck of an instrument, while leading the back of the neck unencumbered. In another aspect, a capo according to the invention is adapted to couple to the instrument neck at any point along that neck.

In yet another aspect, a capo according to the invention is applicable to an instrument of any configuration of neck and fingerboard. According to still another aspect of the invention, a capo is readily reconfigurable, even during the course of playing a particular piece of music. Still other features of the invention, in various embodiments, include simplicity of design and manufacture and easy replaceability of various capo components.

These and other advantages and features of the invention will be more readily understood in relation to the following detailed description of the invention, which is provided in conjunction with the accompanying drawings.

DETAILED DESCRIPTION OF THE INVENTION

Figure 1:
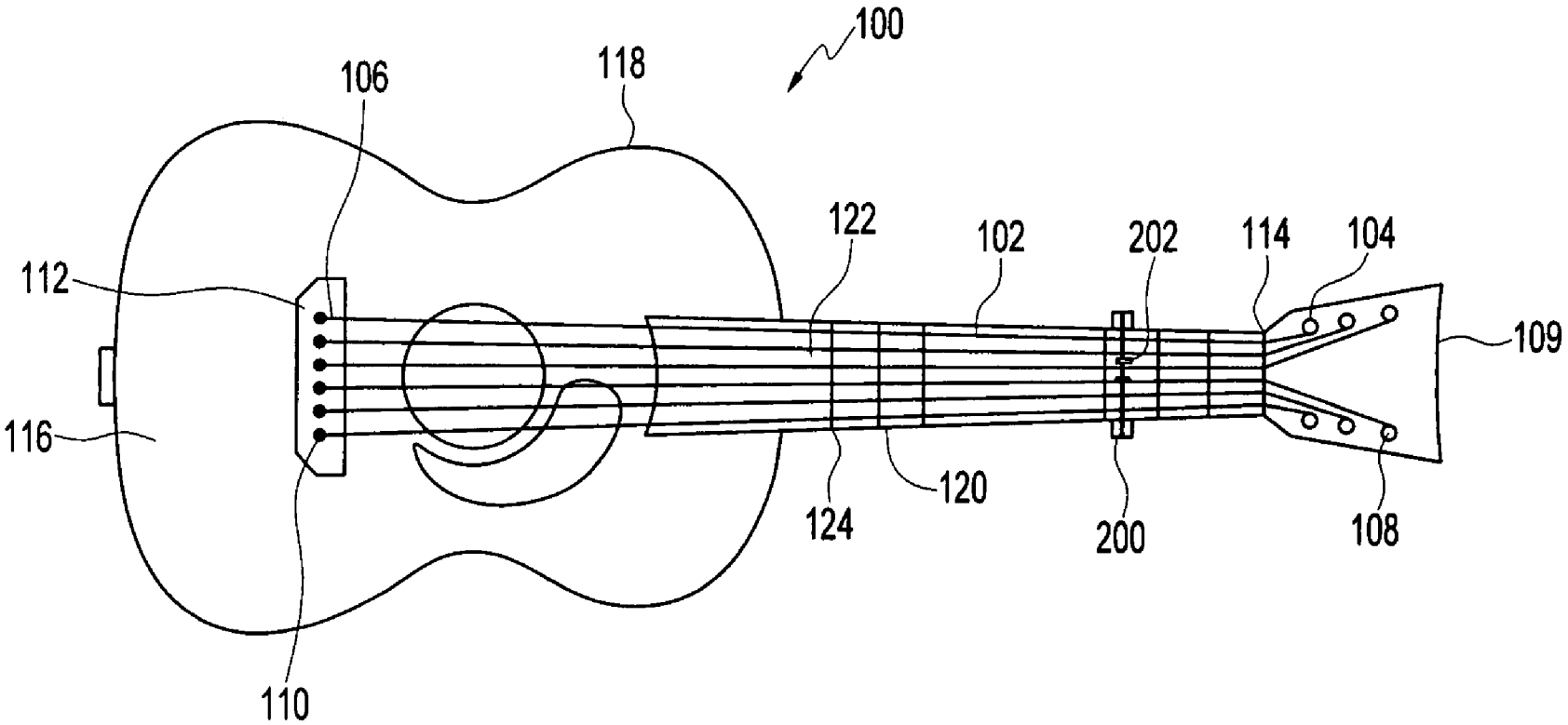
FIG. 1 shows a stringed instrument including a capo according to one embodiment of the invention.

The present invention will be described as set forth in the exemplary embodiments illustrated in FIGS. 1-16. Other embodiments may be utilized and structural or functional changes may be made without departing from the spirit or scope of the present invention. Like items are referred to by like reference numerals.

The present invention relates to a capo that can be fastened on the neck of a stringed instrument, thereby shortening an effective length of a string, to alter the string's sound.

Referring to FIG. 1, one sees a stringed instrument, here a guitar 100, including a capo according to one aspect of the invention. Illustrated features of the guitar and capo include a plurality of strings 102, having respective first 104 and second 106 ends. Each string is coupled at its first end 104 to a tuning peg 108 and at its second end to a string peg 110 or other bridge fastening mechanism. Each string is stretched between a bridge 112 and nut 114. Typically, the bridge 112 is supported on a soundboard 116. The soundboard is coupled to a resonant chamber 118, which is in turn coupled to an elongated neck 120 of the instrument. The neck 120 includes a fingerboard 122 having an elongated shape similar to that of the neck 120. One or more frets 124 may be disposed on a top surface of the fingerboard. The one or more frets 124 each has an edge disposed in transverse relation to a longitudinal axis of the neck. The tuning pegs 108 are supported by a headstock 109. The neck, strings, and fingerboard, are arranged such that the strings are disposed in generally parallel spaced relation to a longitudinal axis of the fingerboard and in spaced relation to the fingerboard. As shown in FIG. 1, according to one aspect of the invention, a capo 200 is coupled to the neck of the instrument. The capo includes at least one string-contacting member 202 adapted to contact a respective string 102.

Figure 2:
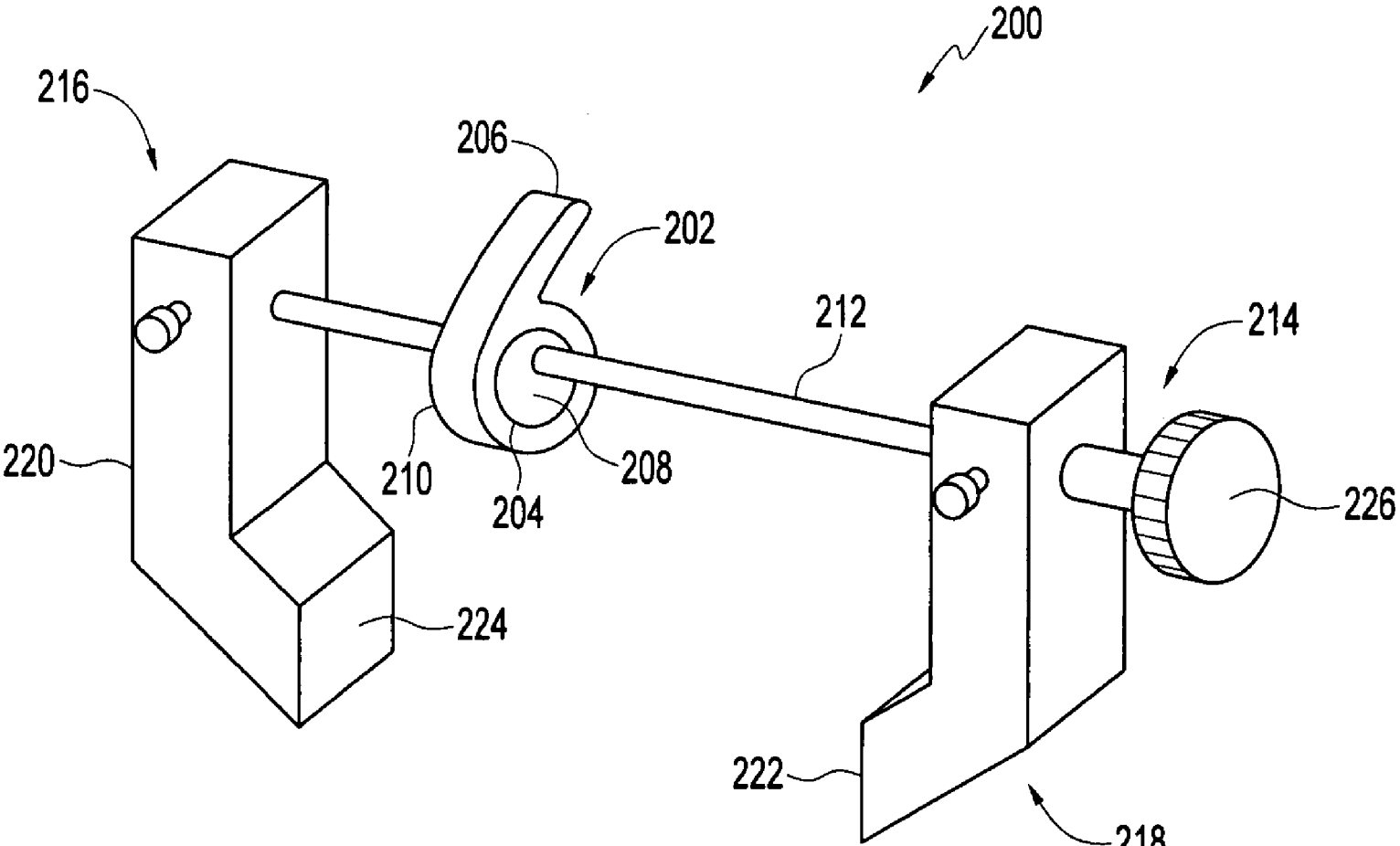
FIG. 2 shows an isometric view of a portion of a capo according to one embodiment of the invention.

FIG. 2 shows an isometric view of the capo 200 of FIG. 1. The capo includes a string-contacting member 202. In the illustrated embodiment, the string-contacting member 202 includes a cam member having a body portion 204 and a lever portion 206. As shown, the body portion includes a first side surface 208. A second side surface 210 is disposed in substantially parallel spaced relation to the first side surface 208. A through hole is disposed between the first side surface 208 and the second side surface 210, and a shaft 212 is disposed within the through hole. The shaft has a longitudinal axis, a first end 214 and a second end 216. The shaft 212 is supported proximate the first end 214 by a first jaw member 218, and proximate the second end 216 by a second jaw member 220.

The jaw members 218, 220 each include a respective jaw surface 222, 224. As shown in FIG. 1, the jaw surfaces are adapted to couple to the guitar neck 120 so as to support the shaft 212 in spaced relation to the fingerboard 122 and strings 102 of the guitar. According to the illustrated embodiment of the invention, the longitudinal axis of the shaft 212 is disposed in substantially perpendicular spaced relation to a longitudinal axis of the neck 120. According to one aspect of the invention, a mechanism is provided for urging the jaw members 218, 220 toward one another, and toward the neck of the instrument 120 disposed between the respective jaw surfaces 222, 224. In FIG. 2, this mechanism is shown to include a knob 226. As will be described in further detail below, the knob 226 may be threaded and arranged such that rotation of the knob 226 operates to urge the jaw members inwardly.

Figure 3:
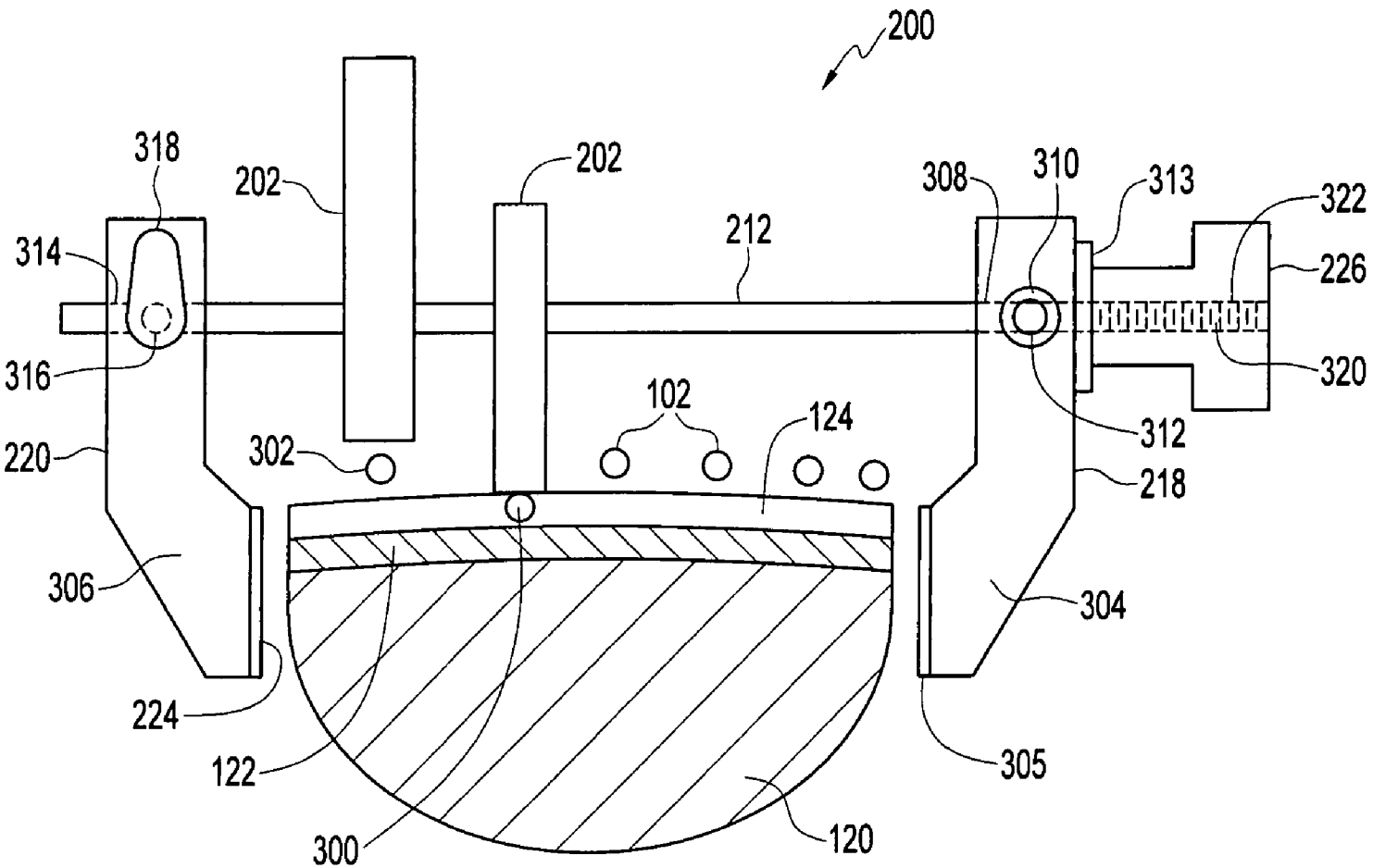
FIG. 3 shows a section through a neck of a stringed instrument and a capo according to one aspect of the invention.

FIG. 3 shows a relative relationship of the capo 200 and guitar 100 including a cross-section of the guitar neck 120, first 218 and second 220 jaw members, exemplary string-contacting members 202 and shaft 212. Also shown is the fingerboard 122 and a fret 124 along with a plurality of strings 102. As illustrated in FIG. 3, one string-contacting member is activated to bring a first string 300 into contact with the illustrated fret 124. A second string-contacting member is deactivated such that a corresponding second string 302 is disposed above the fret 124 and does not contact the fret.

In one embodiment, as shown in FIG. 3, a jaw member 218, 220 includes a first rigid portion 304 and a second cushioned portion 305. The first rigid portion 304 and a second rigid portion 306 may be formed of a structural material such as metal, wood, ceramic, plastic, plastic composite such as glass filled Lexan or other substantially rigid material. In one embodiment of the invention, the rigid portions 304, 306 are formed of brass. In another embodiment of the invention, the rigid portions 304, 306 are formed of aluminum.

In another embodiment of the invention, the rigid portion 304 is formed of different material than rigid portion 306. According to various aspects of the invention, these rigid portions may include decorative colorings and/or patterns. The cushioned portion 305 is formed of a material having a lower durometer than the rigid portion 304. The cushioned portion 305 may include an appropriate material, such as canvas, polyurethane, leather, rubber, vinyl, polypropylene, polyethylene, polytetrafluoroethylene (PTFE), or other material, as would be selected by one of skill the art. In one aspect of the invention, the cushioned portion 305 is adapted to distribute force evenly over the jaw surfaces 222, 224 so as to prevent scratching or compression damage to the neck 120 of the instrument.

In a further aspect of the invention, the material of the cushioned portion 306 provides a high coefficient of friction with respect to the jaw surface 222, 224 and the neck of the instrument. In yet another aspect, the material of the cushioned portion 306 provides a surface that conforms under pressure to a shape of the guitar neck. In a still further embodiment of the invention, the cushioned portion 306 may comprise a plurality of cushioned portions, each having a respective shape and durometer. Accordingly, the jaws 218, 220 may be sturdily coupled to, and rendered substantially immobile with respect to, the neck 120 of the instrument.

In a further embodiment of the invention, the jaws 218, 220 are formed of a single material of intermediate durometer. For example the jaws 218, 220 may be formed of ultrahigh molecular weight polyethylene (UHMWPE). Ideally, such a material is selected to have a durometer that prevents scratching or damage to the guitar neck 120 by application of the capo 200 and the material is also rigid enough to provide the capo with structural integrity.

It is desirable to have a mechanism for tightening the jaw surfaces 222, 224 against the neck 120 of the instrument. In one embodiment this mechanism includes a plurality of external threads 320 on a circumferential surface of the shaft 212. Also included is a knob 226. The knob has an internal surface 322 defining a longitudinal hole therethrough. The internal surface 322 has a plurality of internal threads thereon such that the knob is adapted to receive the externally threaded shaft and advance the jaw member 304 toward the instrument neck 120 in response to rotation of the knob 226.

In a further embodiment of the invention, the knob may include a bore having an externally threaded shaft disposed coaxially therewithin. The externally threaded shaft is adapted to mate with matching internal threads within a corresponding bore disposed coaxially the shaft 212.

The knob may be formed of a metal, such as brass or aluminum, or of plastic, or other appropriate material. The knob may include a patterned surface, such as for example a knurled surface, or a shape such as an elongated shape, adapted to improve mechanical coupling between a musician's fingers and the knob during tightening of the knob. As would be understood by one of ordinary skill in the art, other mechanisms such as, for example, a toggle mechanism could be substituted for the threaded knob to achieve the function of urging the two jaw members 218, 220 toward one another, and toward the neck of the instrument.

In one illustrated embodiment of the invention, the jaw member 218, includes a first hole 308 formed therein for receiving the shaft 212. The first hole has a longitudinal axis. The jaw member 218 also includes a second hole 310 formed therein. The second hole 310 has a longitudinal axis disposed in substantially perpendicular relation with respect to the longitudinal axis of the first hole. According to one embodiment of the invention, the second hole 310 is adapted to receive a first retainer device 312, such as a thumb-screw (illustrated), set-screw, spring operated detent cam operated detent, or other detent mechanism.

In one aspect of the invention, an inward end of the first retainer device 312 impinges on a flat surface of the shaft 212 to prevent rotation of the jaw member 218 about the shaft 212. In another embodiment of the invention, the capo includes a washer 313 disposed coaxially about the shaft 212 between the knob 226 and the jaw member 218.

According to one embodiment of the invention, the jaw member 220 also includes a third hole 314 formed therein for receiving the shaft 212. The third hole has a longitudinal axis. The jaw member 220 has a fourth hole 316 formed therein. The fourth hole 316 has a longitudinal axis disposed in substantially perpendicular relation with respect to the longitudinal axis of the third hole. The fourth hole 316 is adapted to receive a second retainer device 318, such as a cam operated detent (illustrated), set-screw, spring operated detent, thumb-screw, or other detent mechanism.

Figure 4:
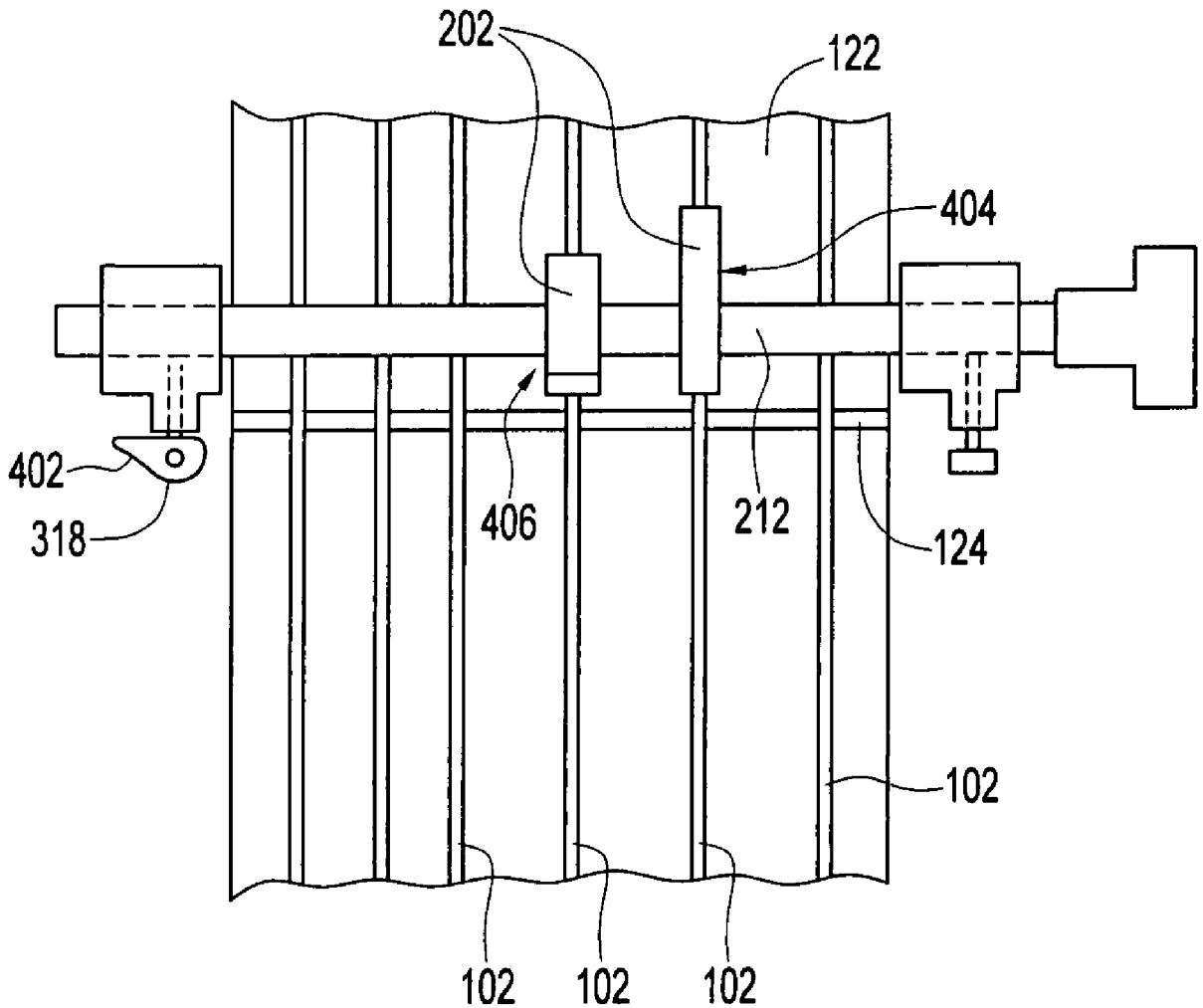
FIG. 4 shows, in top view, a portion of a neck and strings of an instrument along with a capo according to one embodiment of the invention.

FIG. 4 shows a top view of a portion of a stringed instrument including a capo according to one embodiment of the invention. In FIG. 4, the fingerboard 122, an exemplary fret 124 and a plurality of strings 102 are visible. Also illustrated is a cam lever 402 of a cam operated detent retainer device 318. Exemplary first and second string-contacting members 202 are shown. According to the illustrated embodiment, one 404 of the string-contacting members 202 is disposed in an active orientation, such that the effective length of the corresponding string is shortened. The other 406 of the string-contacting members 202 is disposed in an inactive orientation, such that the corresponding string is not in contact with the string-contacting member 202.

For illustrative purposes, FIG. 4 shows only two string-contacting members 202. In practice, string-contacting members 202 may be readily added to or removed from shaft 212 depending on the number of strings present on a particular instrument, and on the preferences of a particular musician. The musician may wish to have one string-contacting member for each string so that the corresponding string may be clamped or de-clamped at will. In other circumstances, the musician may wish to clamp and de-clamp only a limited number of strings. Accordingly the number of string-contacting members 202 placed on the shaft 212 of the capo 200 may be fewer than the number of strings 102 on the instrument.

Figure 5A:
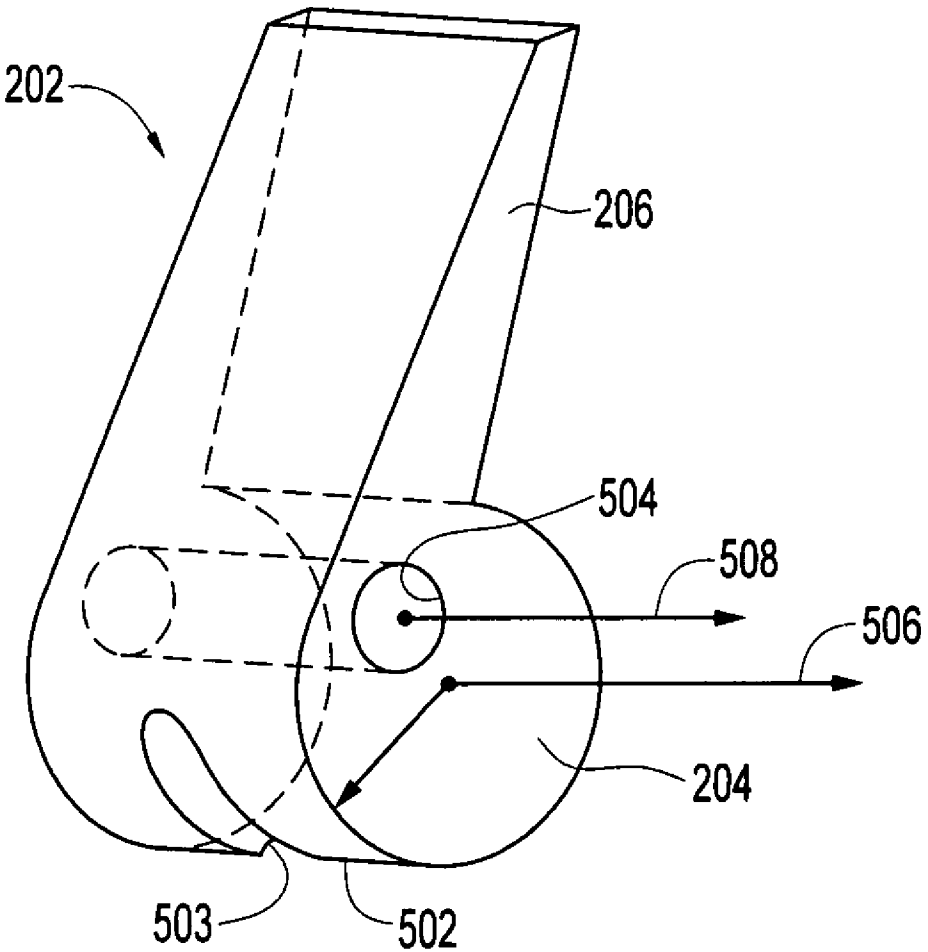
FIG. 5*a* shows an isometric view of a cam string-contacting member according to one embodiment of the invention.

FIG. 5*a* shows an exemplary string-contacting member 202 according to one embodiment of the invention. As described above, the string-contacting member 202 includes a body portion 204 and a lever portion 206. A curved surface 502 of the string-contacting member is adapted to impinge upon a corresponding string 102 and urge the string towards the fingerboard 122 as shown in FIG. 3. An internal cylindrical surface 504 defines a hole in the string-contacting member adapted to receive the shaft 212.

According to one aspect of the invention, a radial tolerance between the internal surface 504 and an outer surface of the shaft 212 is sized to allow the string-contacting member to rotate about the shaft, so as to activate and deactivate the string-contacting member when moderate finger force is applied to the lever portion 206 of the string-contacting member. This tolerance also allows lateral adjustment of a position of the string-contacting member along a longitudinal axis of the shaft 212. Accordingly, the capo may be applied to instrument necks of varying string spacing. The capo may also be applied at varying locations on the neck of an instrument, the strings of which converge (or diverge) between bridge and nut.

According to one embodiment, the body portion 204 defines a substantially circular cylindrical solid about an axial centerline 506. The hole defined by internal surface 504 is disposed such that an axial centerline 508 of the hole stands in substantially parallel spaced relation to the axial centerline 506 of the body portion. This offset arrangement of the hole causes the string-contacting surface 502 to approach the fingerboard as the string-contacting member 202 is rotated about the shaft 212. By rotating the string-contacting member 202 to varying degrees, the force applied to a corresponding string may be varied. Also, the same capo may be used with instruments of differing string height, with instruments having flat fingerboards, and with instruments having curved fingerboards. According to one aspect of the invention, the string contacting surface 502 includes a groove 503 adapted to receive a string therewithin. This groove 503 serves to align the string with respect to the string contacting member 202 and prevent the string from escaping from beneath the string contacting surface 502.

The simplicity of the activating motion, which requires only rotation of the string-contacting member 202 about the shaft 212, allows a musician to clamp and de-clamp a string during the course of a musical performance.

Figure 5B:
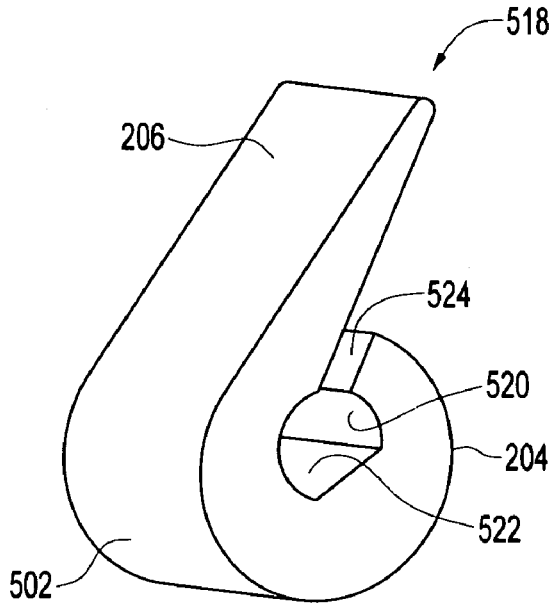
FIG. 5*b* shows an isometric view of a cam string-contacting member including a radial slot according to one embodiment of the invention.

FIG. 5*b* shows a further embodiment of a string contacting member 518. As in the FIG. 5*a* embodiment, the FIG. 5*b* string contacting member includes a body portion 204, a lever portion 206 and a string contacting surface 502. Also as in the FIG. 5*a* embodiment, the FIG. 5*b* embodiment includes an offset hole defined by an internal surface 520. The internal surface 520 includes a substantially cylindrical portion and a substantially flat portion 522. The string contacting member may be rotated about a shaft that has a corresponding flat surface, such that when the flat surface of the shaft and the flat portion 522 are aligned, the string contacting member tends to remain in a stable position. In a further aspect of the invention, the string contacting member 202 includes a slot 524 disposed radially between the internal surface 520 of the hole and the string contacting surface 502. The slot 524 permits the internal diameter of the hole defined by surface 520 to marry flexibly as the string contacting member 518 is rotated about the shaft. In this way, the string contacting a member may be moved to and away from the stable position noted above.

Figure 5C:
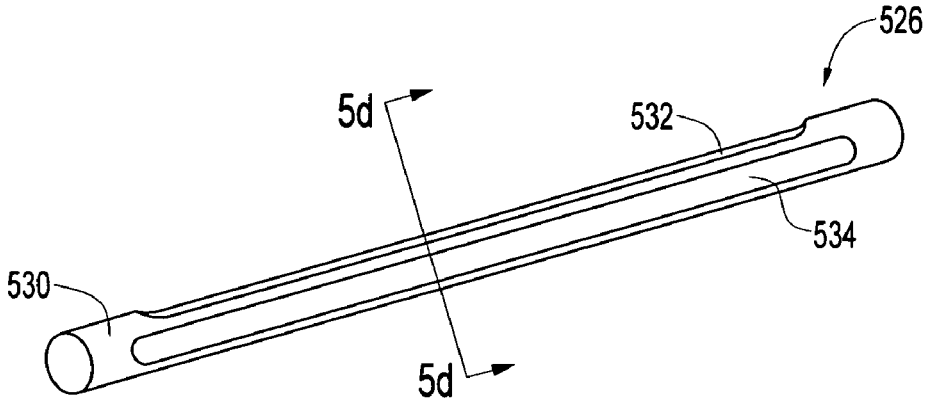
FIG. 5*c* shows an isometric view of a shaft according to one embodiment of the invention.
Figure 5D:
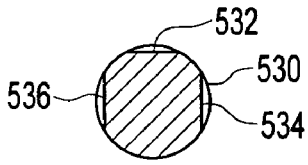
FIG. 5*d* shows a section through the shaft of FIG. 5*c;*

FIG. 5*c* shows a shaft 526 according to one embodiment of the invention. According to one embodiment of the invention, the shaft 526 combined a substantially cylindrical outer surface portion 530 with three flat surface portions 532, 534 and 536 (as seen in FIG. 5*d*). FIG. 5*d* shows the shaft 526 in section. As would be understood by one of ordinary skill in the art, flat surface portions 532, 534 and 536 may be formed by, for example, machining an otherwise cylindrical shaft.

In operation, the shaft 526 may be disposed within the hole of the string contactor 518. In a first stable position, the flat surface 522 may be disposed adjacent flat surface 532. In a second stable position, the flat surface 522 may be disposed adjacent flat surface 534. Accordingly, the string contactor may be moved by application of force to the lever portion 206 from the first stable position to the second stable position. In addition, the flat surface 524 may serve to receive an end of a retainer device 312 (as shown in FIG. 3), thereby stabilizing a relative orientation between the shaft 526 and a jaw portion such as that identified in FIG. 3 with reference numeral 218.

Figure 6B:
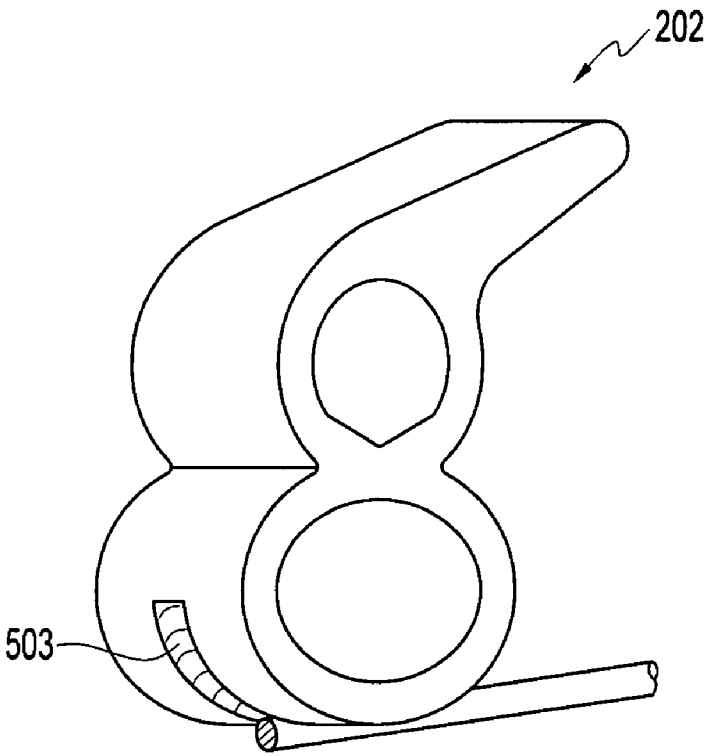
FIGS. 6*a* and 6*b* show, respectively, a side view and an isometric view of a cam string-contacting member according to a further embodiment of the invention.
Figure 6A:
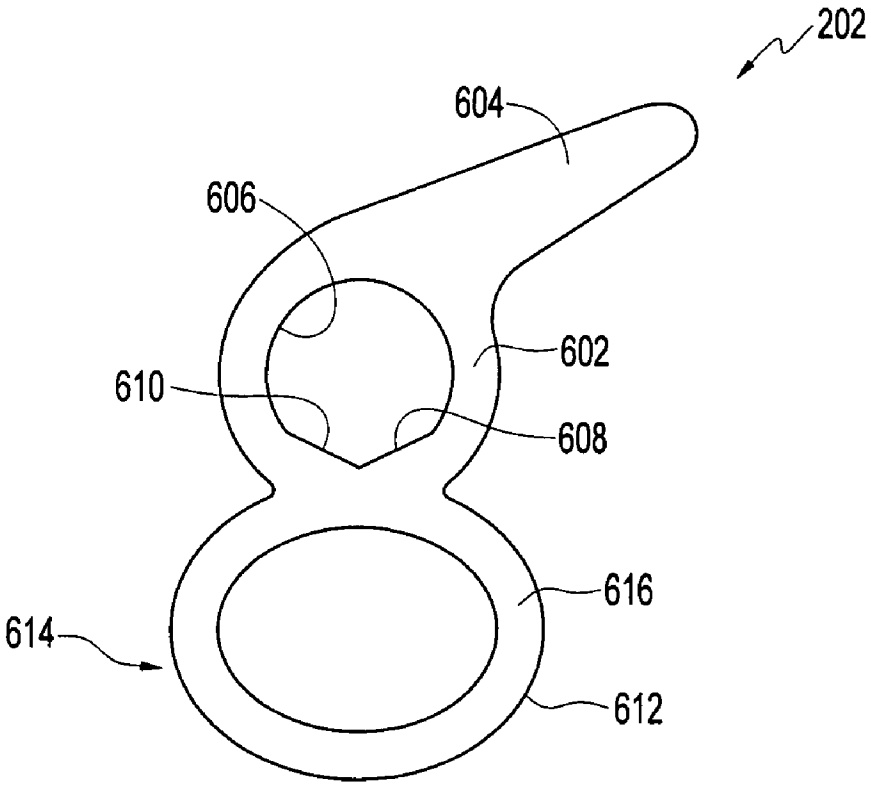

FIG. 6*a* shows a string-contacting member 202 according to a different embodiment of the invention. The string-contacting member of FIG. 6*a* includes a body portion 602 and a lever portion 604. The body portion 602 has an internal surface 606 defining a hole therethrough. Unlike the internal surface 504 of the FIG. 5*a* embodiment, which is substantially circular, and the FIG. 5*b* embodiment, which includes a single flat surface portion, the internal surface of the FIG. 6*a* embodiment includes a first flat portion 608 and a second flat portion 610. The string-contacting member 202 also includes an elastic portion 612. The elastic portion has a string contacting surface 614 adapted to impinge upon a corresponding string when the string-contacting member 202 is activated. In the illustrated embodiment, the elastic portion includes a tubular member having a flexible wall 616 coupled to the body portion 602 of the string-contacting member 202. The flexible wall 616 is adapted to be elastically deformed and thereby apply pressure to the corresponding string. FIG. 6*b* shows the string contacting member of FIG. 6*a* in an isometric view. As shown in FIG. 6*b*, according to one aspect of the invention, a string contacting surface of the string contacting member includes a groove 503 adapted to receive a string of the instrument.

The string-contacting member 202 may be integrally formed of a single material of appropriate durometer, such as Delrin. In an alternative embodiment, the string-contacting member may be formed of more than one material, such that the body portion 602 is formed of a first material and the elastic portion 616 is formed of a second different material.

Figure 7B:
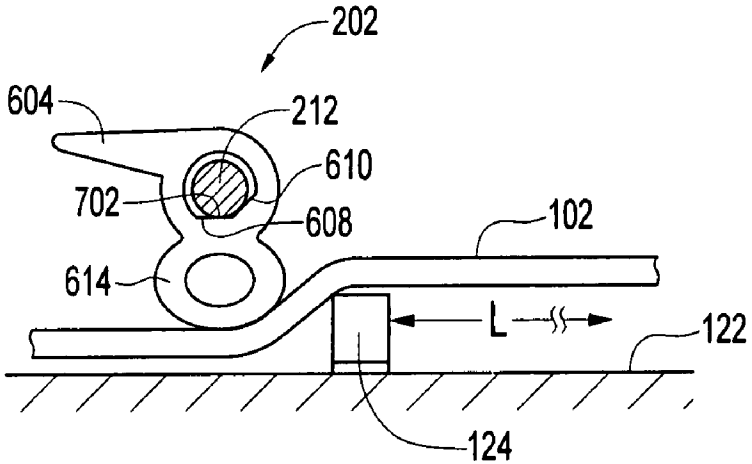
FIGS. 7*a* and 7*b* show a string-contacting member according to one embodiment of the invention in different operational orientations.
Figure 7A:
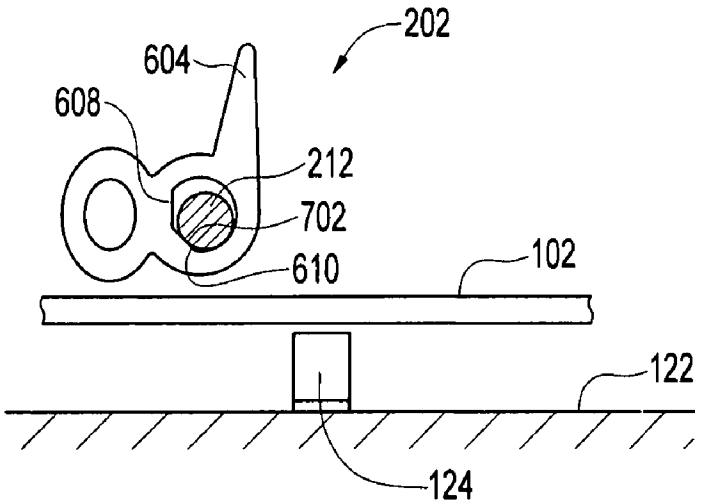

FIG. 7*a* shows the string-contacting member of FIG. 6 disposed in an inactive orientation. The second internal flat surface 610 of the string-contacting member 202 is disposed in contact with a flat surface 702 of the shaft 212.

FIG. 7*b* shows a string-contacting member 202 as in FIG. 6 and a shaft 212 in cross-section in relation to a corresponding string 122. The string-contacting member 202 is shown disposed in an active orientation. The first internal flat surface 608 of the string-contacting member is disposed in contact with the flat surface 702 of the shaft 212. As would be understood by one of skill in the art, the first and second illustrated orientations each represent a point of stable equilibrium. Accordingly, once placed in a selected orientation, the string-contacting member tends to remain in that orientation until moved by force applied to the lever portion 604. In the orientation of FIG. 7*b*, the flexible portion 614 is elastically compressed between the shaft 212 and the string 102. The flexible portion 614 urges the string 102 toward the fingerboard 122 over the fret 124. Consequently, the effective length L of the string 102 is shortened and the tone produced by the string, when plucked, is correspondingly elevated.

Figure 8:
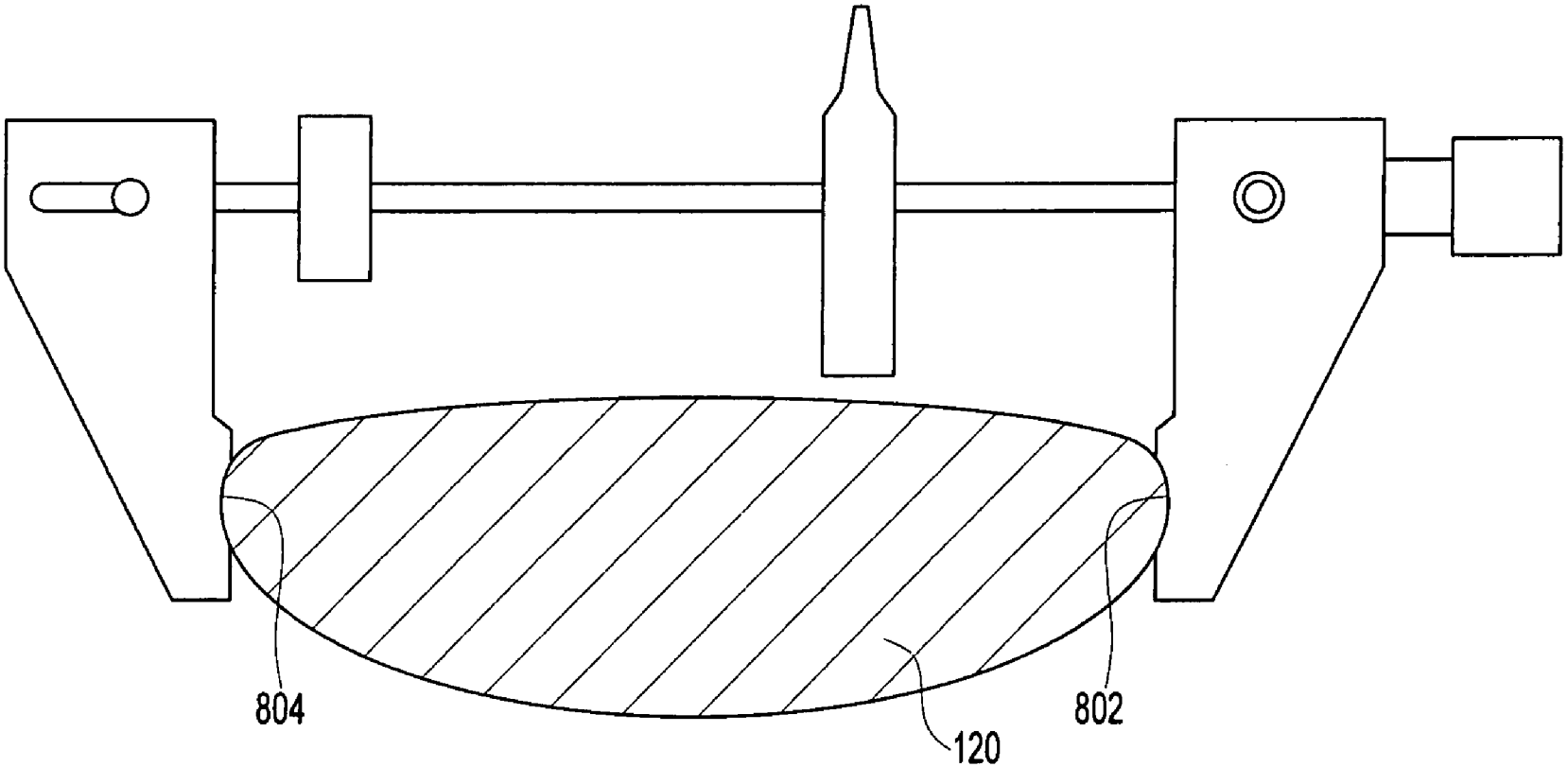
FIG. 8 shows a capo according to one embodiment of the invention.

FIG. 8 shows an embodiment of the invention in which the jaw portions 218, 220 each include a respective concave surface 802, 804. These concave surfaces are adapted to more securely grip corresponding surfaces of the neck 120.

Figure 9:
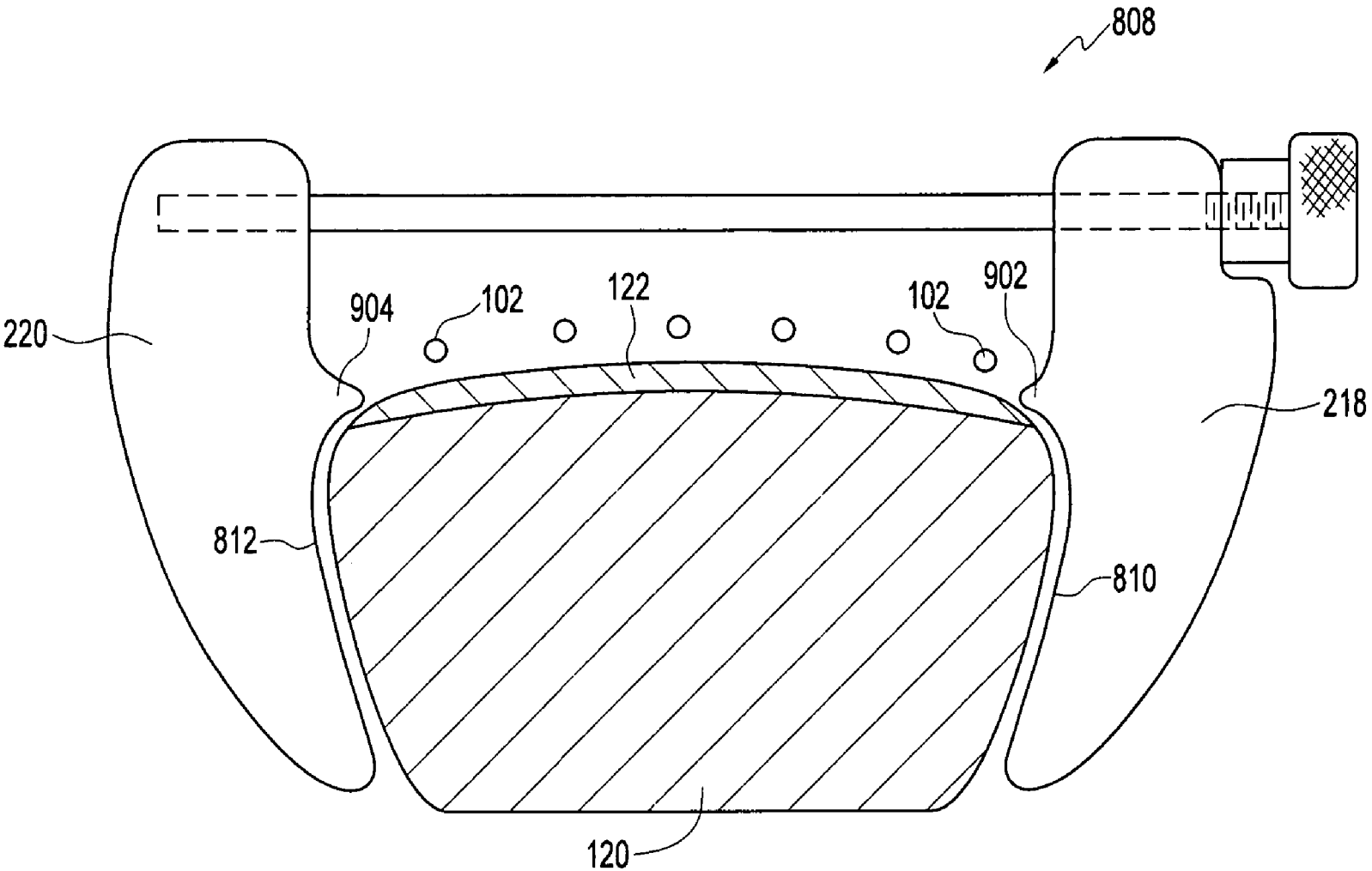
FIG. 9 shows a capo and instrument neck according to another embodiment of the invention.

FIG. 9 shows a further embodiment of the invention 808 in which concave surfaces 810, 812 are formed to contact an extended portion of the side of the neck 120 (shown in cross-section). Each jaw member 218, 220 also includes a respective extension 902, 904 adapted to protrude over a portion of the upper surface of the fingerboard 122. The length of these extensions is limited, so as to avoid interference with the strings 102 of the instrument. Because the jaw members 218, 220 contact only the sides of the neck, a single capo is adapted to be applied to instruments having a wide range of neck thicknesses.

Figure 10:
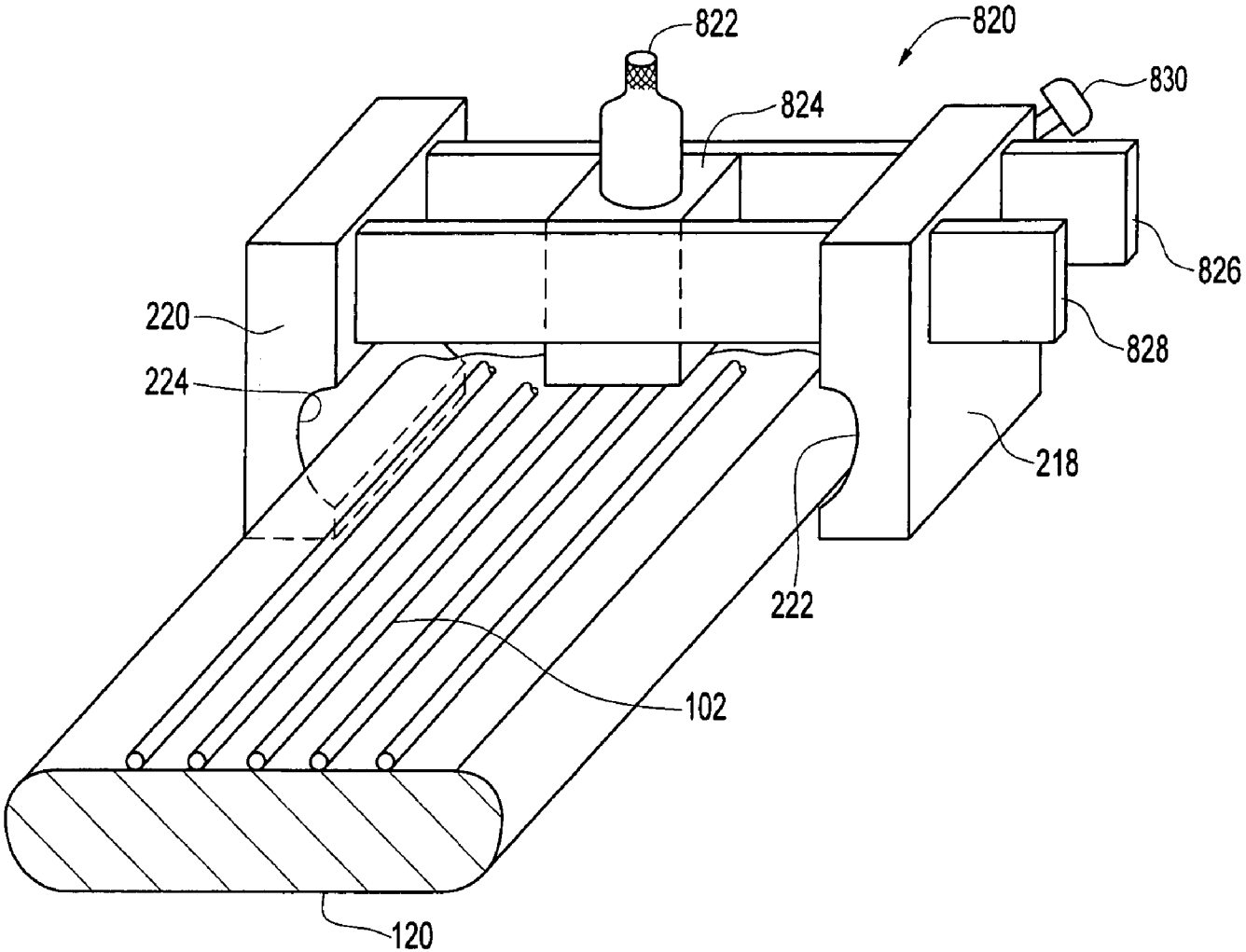
FIG. 10 shows a capo and instrument neck according to another embodiment of the invention.

FIG. 10 shows a further embodiment of the invention 820. As shown in FIG. 10 a capo includes one or more plungers 822. Each plunger 822 is supported within a respective bearing member 824. Each bearing member 824 is supported between a first lateral member 826 and a second lateral member 828. The first 826 and second 828 lateral members are, in turn, supported between first 218 and second 220 jaw members.

As discussed above, the jaw members may be formed of any appropriate material including, but not limited to, brass, aluminum, plastic, ceramic and composite materials such as glass filled Acetal plastic (Delrin®) and glass filled polyamide (Nylon®). In one aspect of the invention, each jaw member includes a respective jaw surface 222, 224. The jaw surfaces 222, 224 are adapted to be tightened against respective opposing surfaces of a neck 120 of a stringed instrument.

According to one aspect of the invention, the first 826 and second 828 lateral members are disposed between the first 218 and second 220 jaw members. The first jaw member 218 is movable with respect to the first 826 and second 828 lateral members. According to a further embodiment of the invention, second jaw member 220 is fixed with respect to the first 826 and second 828 lateral members.

The first jaw member 218 is provided with a tightening and detent mechanism 830 proximate respective first ends of the first 826 and second 828 lateral members. The tightening and detent mechanism 830 is adapted to urge the first jaw member 218 towards the second jaw member 220 by placing one or more of the first 826 and second 828 lateral members in tension, thereby holding the first jaw surface 222 and the second jaw surface 224 firmly in place against the neck 120 of the stringed instrument. In this way, the capo device is removably supported upon the neck of the instrument 120.

The tightening and detent mechanism 830 may include one or more of a cam mechanism, a rack and pinion mechanism, a screw mechanism, a spring mechanism, a thumb-screw mechanism, a set screw mechanism, a lever mechanism, a toggle mechanism, or other fixturing mechanism as is known in the art.

As discussed above, the jaw surfaces 222, 224 may be cushioned or otherwise formed of elastic material in order to prevent damage to the neck 120 of the instrument when the jaw surfaces are tightened against the neck. Also a discussed above, the jaw surfaces 222, 224 may be concave, or otherwise shaped to conform to the shape of the surface of the neck 120 of the instrument.

According to a further aspect of the invention, one or more bearing members 824 are disposed between, and supported by, the first 826 and second 828 lateral members.

Figure 11A:
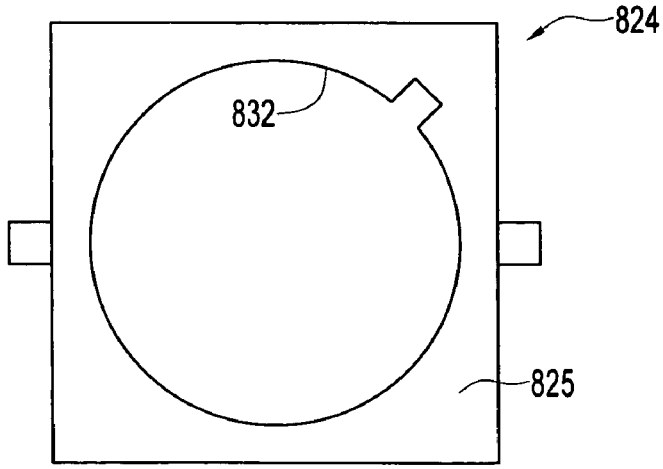
FIGS. 11*a*, 11*b* and 11*c* show a bearing member according to one embodiment of the invention.

FIG. 11*a* shows a top view of a bearing member 824 according to one aspect of the invention. The bearing member 824 includes a top surface 825 and an inward-facing bearing surface 832. According to one exemplary embodiment, this inward-facing bearing surface 832 is substantially cylindrical and circular in shape and defines a passage through the bearing 824.

Figure 11B:
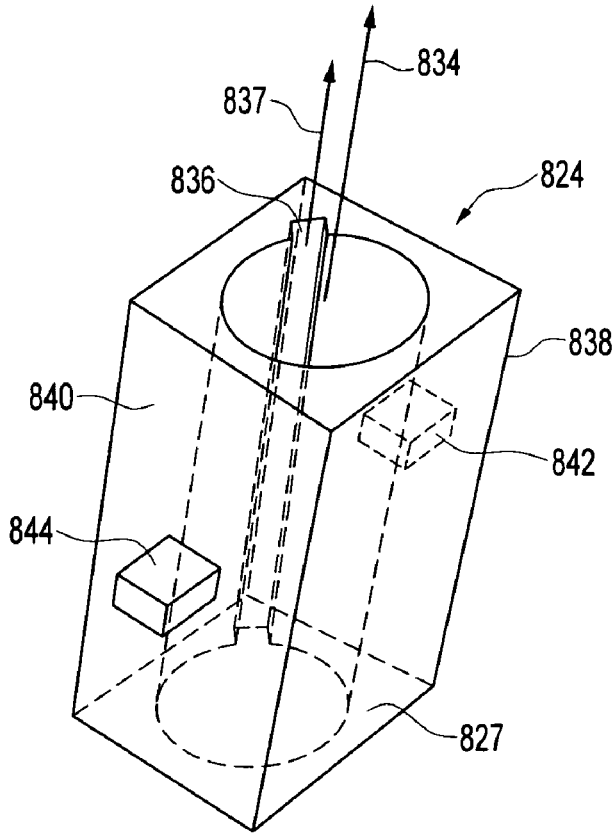

As shown in FIG. 11*b*, the cylindrical passage has a longitudinal axis 834 that, when the bearing is in use, is disposed in substantially perpendicular relationship to a string 102 (as shown in FIG. 10). A slot 836 is disposed in the inward-facing bearing surface 832. The slot 836 has a longitudinal axis 837 disposed in substantially parallel spaced relation to the longitudinal axis 834 of the cylindrical passage.

According to the embodiment shown, the bearing member 824 has a first outer surface 838 and a second outer surface 840. The first outer surface 838 and second outer surface 840 are disposed in substantially parallel spaced relation to one another. According to one embodiment, the outer surfaces 838, 140 are substantially planar. According to further embodiments of the invention, the outer surfaces 838, 840 may be concave or convex, and may include one or more protrusions 842, 844 respectively.

Figure 11C:
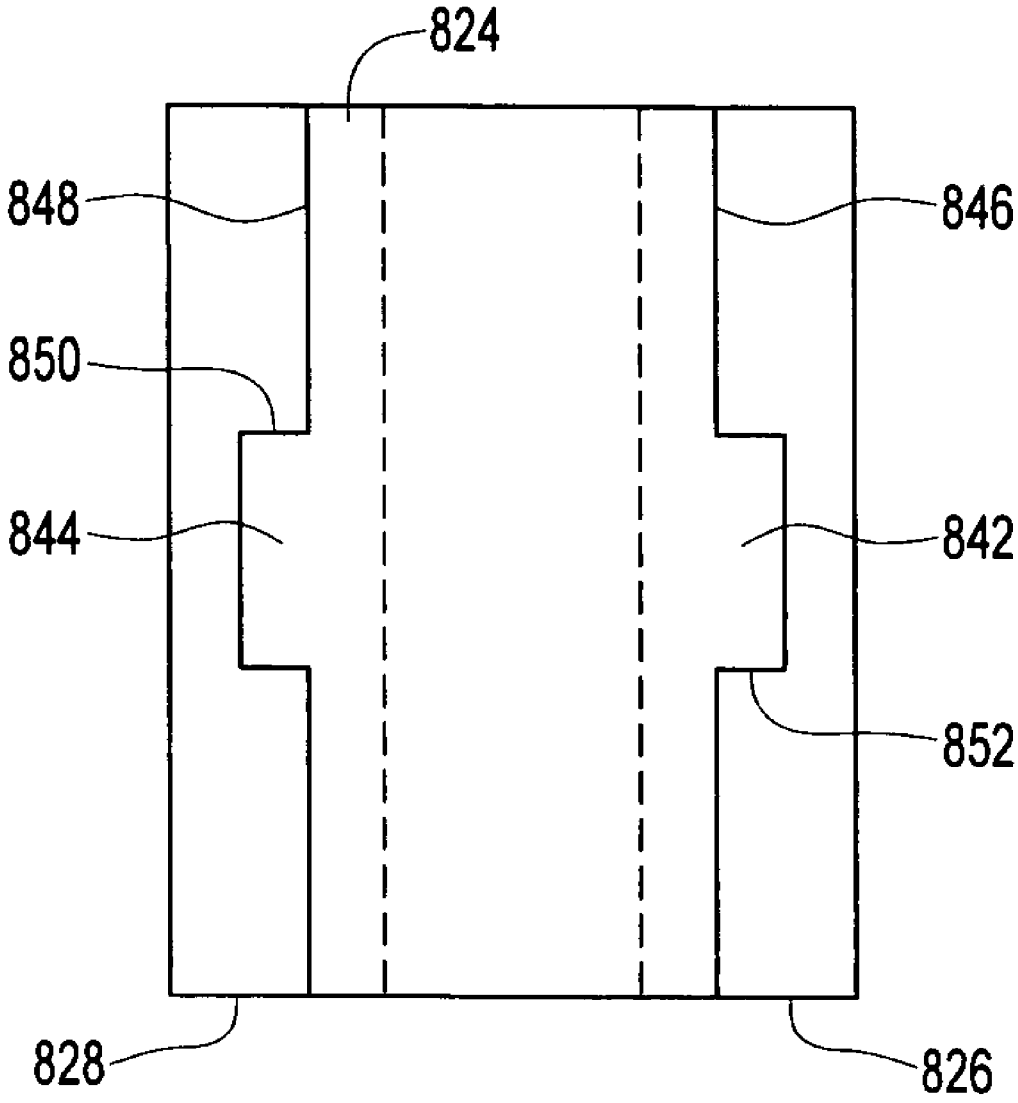

FIG. 11*c* shows the bearing member 824 of FIG. 11*a* in cross-section. Also shown in cross section are the first 826 and second 828 lateral members. According to one embodiment of the invention, each of the first 826 and second 828 lateral members includes a respective inward facing surface 846, 848. Each inward facing surface, 846, 848 includes a respective longitudinal slot 850, 852 therein. The first 850 and second 852 longitudinal slots are adapted to receive the first 842 and second 844 protrusions respectively, thereby maintaining a position of the bearing member 824 with respect to the first 826 and second 828 longitudinal members.

Figure 12:
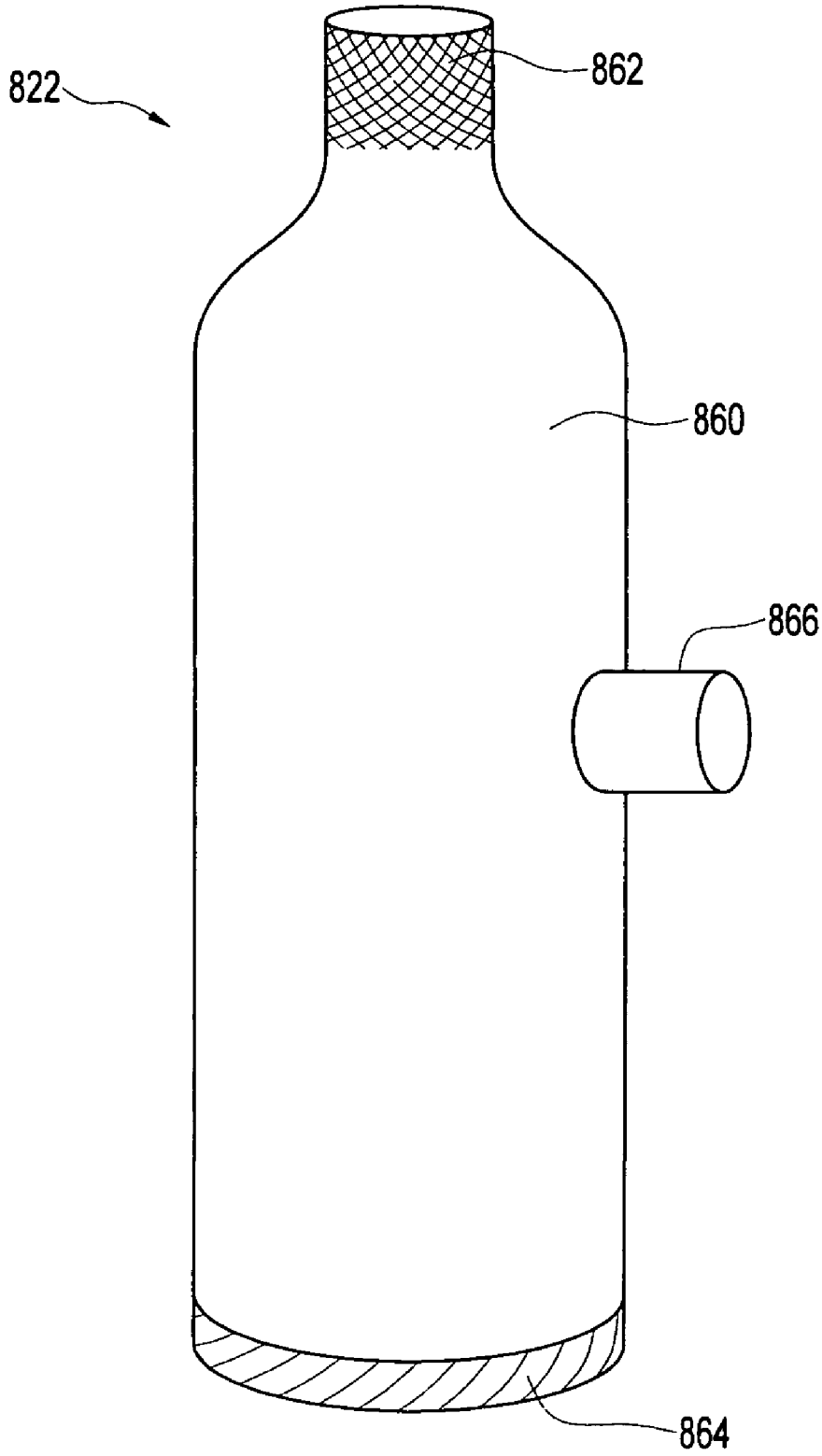
FIG. 12 shows a plunger member according to one aspect of the invention.

FIG. 12 shows a plunger 822, according to one aspect of the invention, in additional detail. According to the embodiment shown, the plunger includes a substantially cylindrical outer surface 860. The plunger 822 also has a gripping portion 862 adapted to be grasped with fingers at a first end, and a string contacting surface 864 at a second end. According to one aspect of the invention, the second end may be cushioned, or otherwise flexible, so as to allow deflection of the string contacting surface 864 when the plunger 822 is pressed against the string. In a still further aspect, the plunger includes a nipple 866 protruding from the outer surface 860 of the plunger 822. The nipple 866 is adapted to fit into, and slide through, the slot 836 of the bearing member 824, as shown in FIG. 11*b*. In operation, the nipple 866 is advanced through the slot 836, as the plunger 822 is urged towards the string. The bearing member 824 is arranged, with respect to the string, such that the nipple 866 emerges from the slot 836 when the string contacting surface 864 is firmly pressed against the string. Thereafter, the plunger 822 is rotated, by the application of finger torque to the gripping portion 862 of the plunger 822. As the plunger 822 rotates, the nipple 866 moves away from the slot 836, so that when the gripping portion 862 is released, the nipple 866 is no longer adjacent the slot 836. Rather, the nipple 866 is adjacent a lower surface 827 (as shown in FIG. 11*b*) of the bearing member 824. The elastic expansion of the plunger, and of any cushioned lower surface, and of the string, urges the nipple against the lower surface 827 of the bearing member 824. Accordingly, fictional forces between an outer surface of the nipple 866, and the lower surface 827 of the bearing member 824 prevent backward rotation of the plunger member and release of the string from below the string contacting surface 864 until a further application of finger torque to the gripping portion 862 of the plunger 822.

Figure 13:
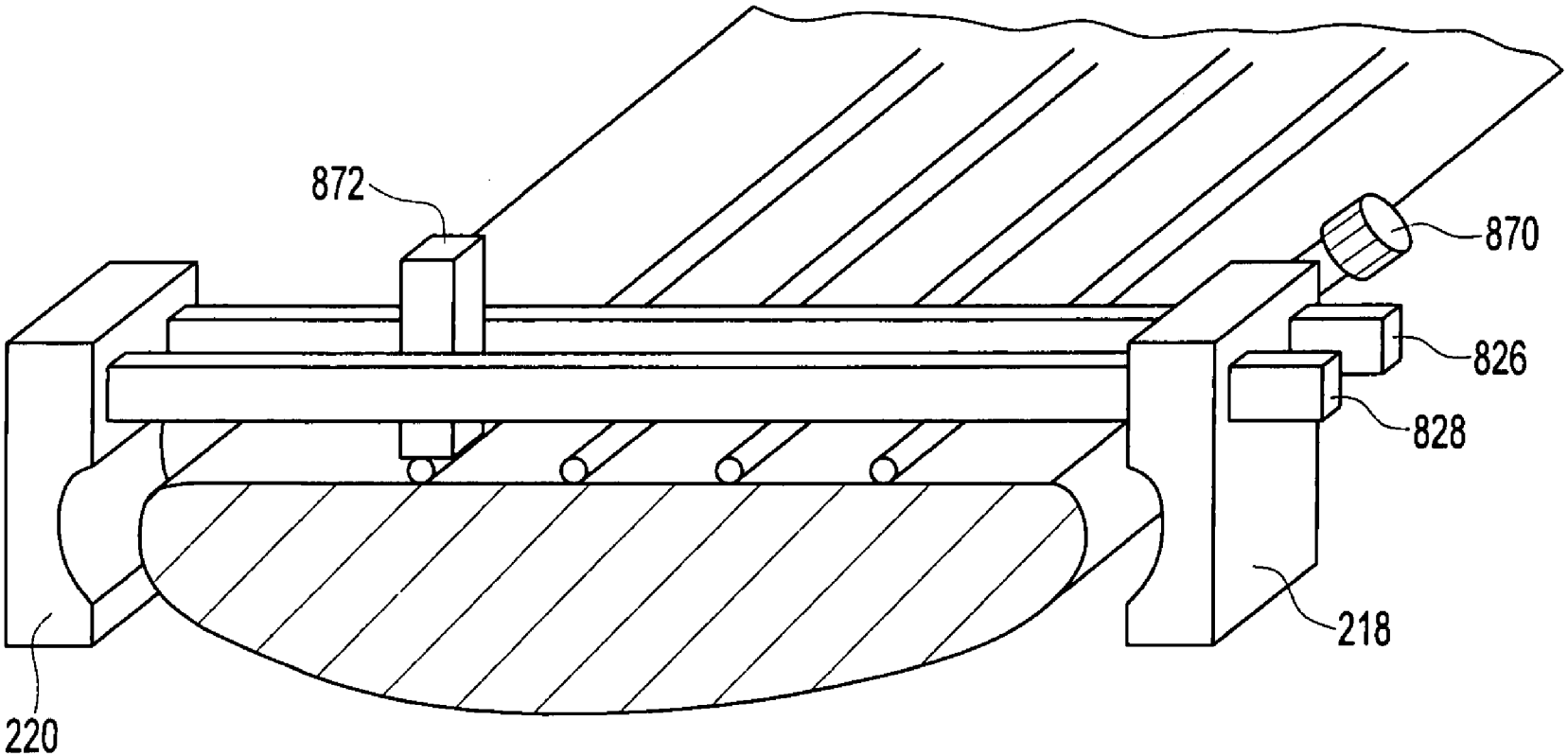
FIG. 13 shows a capo and instrument neck according to one embodiment of the invention.

FIG. 13 shows a capo attached to a neck of a stringed instrument according to a further embodiment of the invention. As shown in FIG. 13, a first lateral member 826 and a second lateral member 828 are each coupled at respective opposite ends to a first jaw member 218 and a second jaw member 220. According to one aspect of the invention, the first and second lateral members 826, 828 are adjustably coupled to the first jaw member 218, and fixedly coupled to the second jaw member 220. According to a further aspect of the invention, a tightening mechanism 870 is provided on the first jaw member 218. The tightening mechanism 870 is adapted to urge the first jaw member 218 towards the second jaw member 220 by placing the lateral members 826, 828 in tension. In various embodiments of the invention, and as would be understood by one of skill in the art, the tightening mechanism 870 may include a worm drive mechanism, a cam mechanism, a toggle mechanism, a rack and pinion mechanism, and/or a ratchet and pawl mechanism.

In a further aspect of the invention, one or more string contacting members 872 are disposed between, and supported by, the first lateral member 826 and the second lateral member 828. According to the illustrated embodiment, the one or more string contacting members 872 are adjusted to align with the strings of the instrument. Thereafter, the jaw members 218, 220 of the capo are positioned adjacent the neck of the instrument, and the tightening mechanism 870 is activated so as to clamp the capo onto the neck of the instrument, whereby the string contacting mechanisms are urged against the respective strings. In this way, the strings are pinched between the string contacting members 872 and the fingerboard of the instrument.

Figure 14:
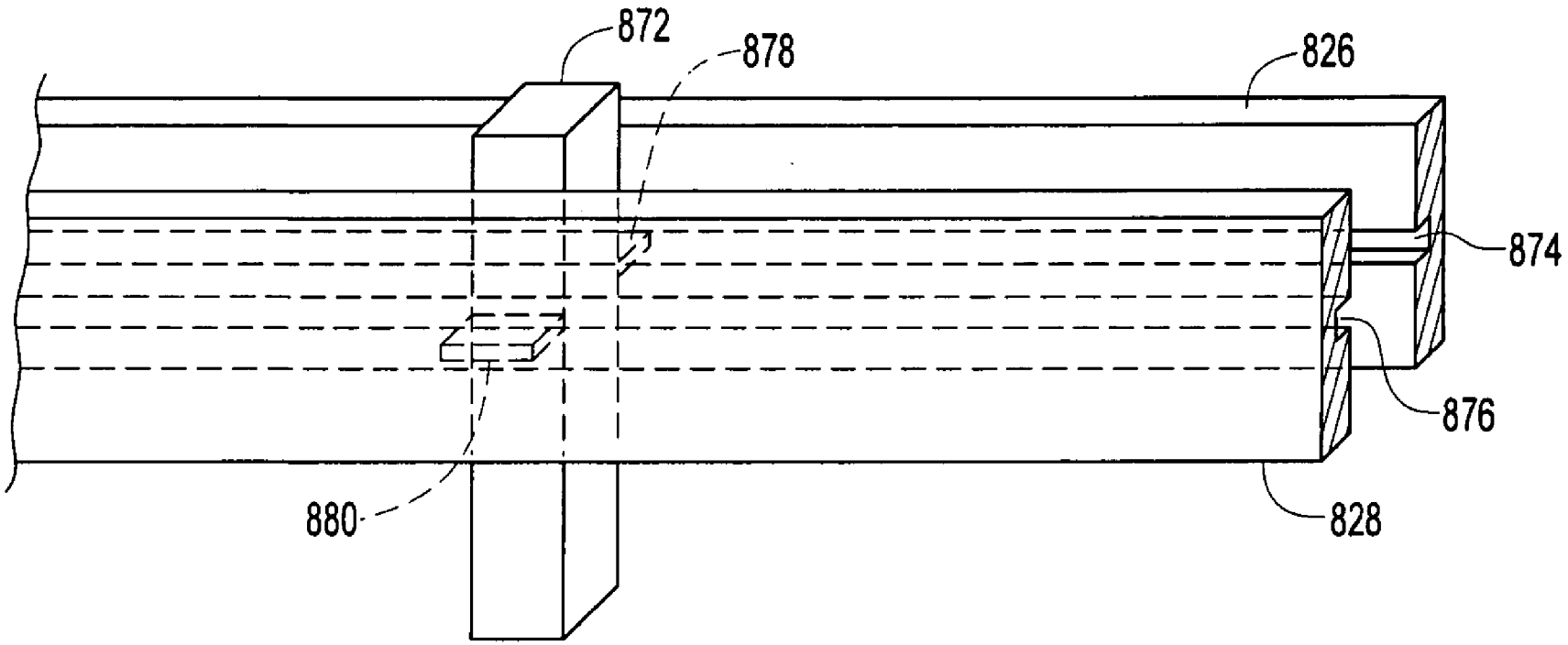
FIG. 14 shows a string contacting member according to one aspect of the invention.

FIG. 14 shows the string contacting member 872 of FIG. 13 in additional detail. In particular one sees that the first 826 and second 828 lateral members each includes a slot 874, 876 in a respective internal surface thereof. The string contacting member 872 has a first protrusion 878 and a second protrusion 880 projecting from opposite sides thereof. The first 878 and second 880 protrusions are adapted to fit within the respective slots 874, 876 of the lateral members 826, 828. In this way, the string contacting member 872 is supported by the lateral members 826, 828. String contacting members of various sizes and configurations may be provided in accordance with the requirements of various stringed instruments.

Figure 15:
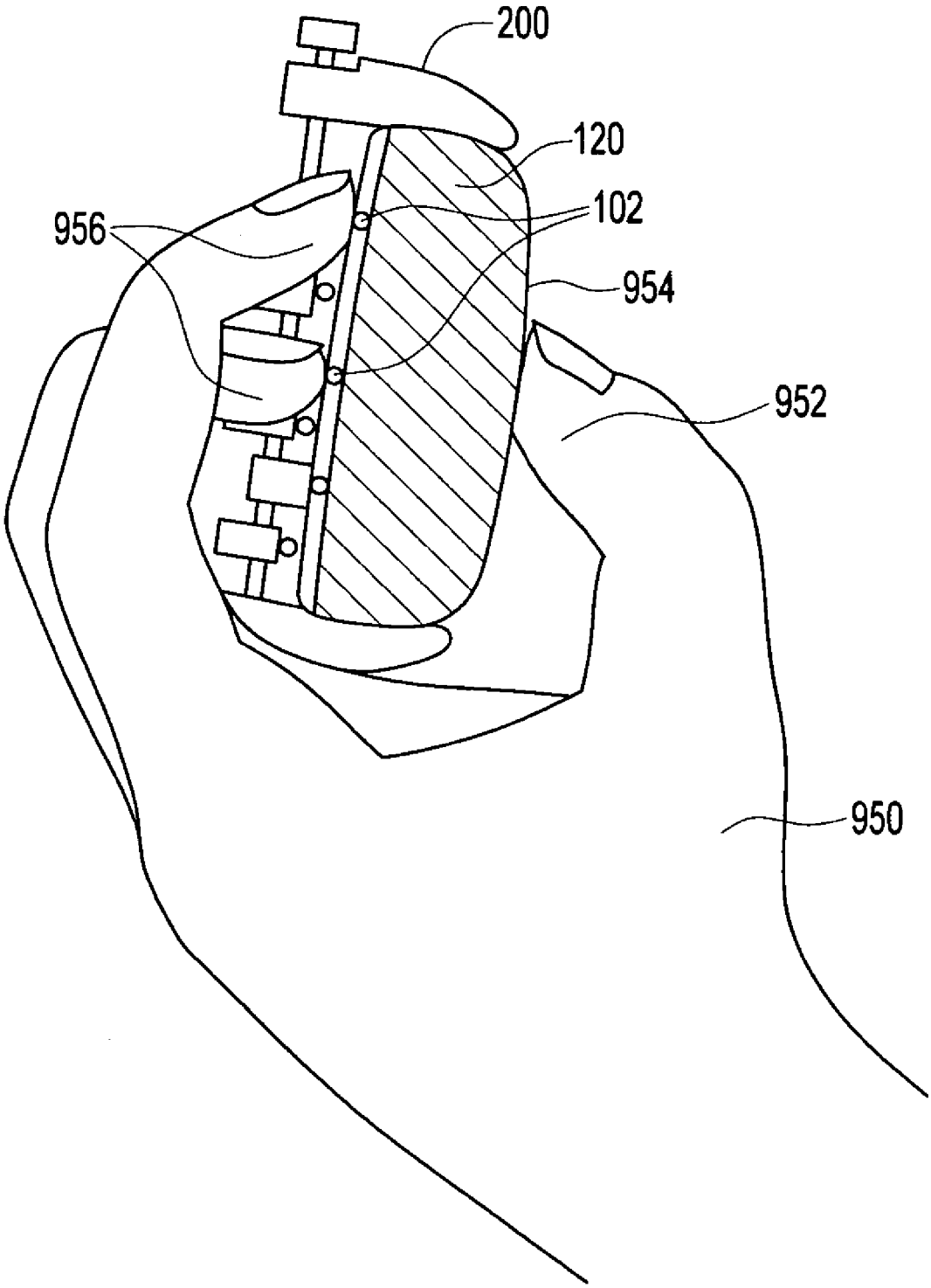
FIG. 15 shows a method of playing a musical instrument including a capo according

FIG. 15 shows a neck 120 of an instrument in cross-section, along with a capo 200 according to one embodiment of the invention. Also illustrated is the placement of a musician's hand 950 with respect to the neck and capo according to a method of playing the instrument and capo combination. According to one aspect of the invention, the musician's thumb 952 is disposed in contact with a rear surface 954 of the neck 120. According to one aspect of the invention, the musician's thumb 952 may be moved along a longitudinal axis of the neck during playing of the instrument without interfering with the capo 200. In a further aspect of the invention, the musician's fingers 956 may be applied to the strings 102 of the instrument at locations both inwardly and outwardly of the capo with respect to the bridge of the instrument.

Figure 16:
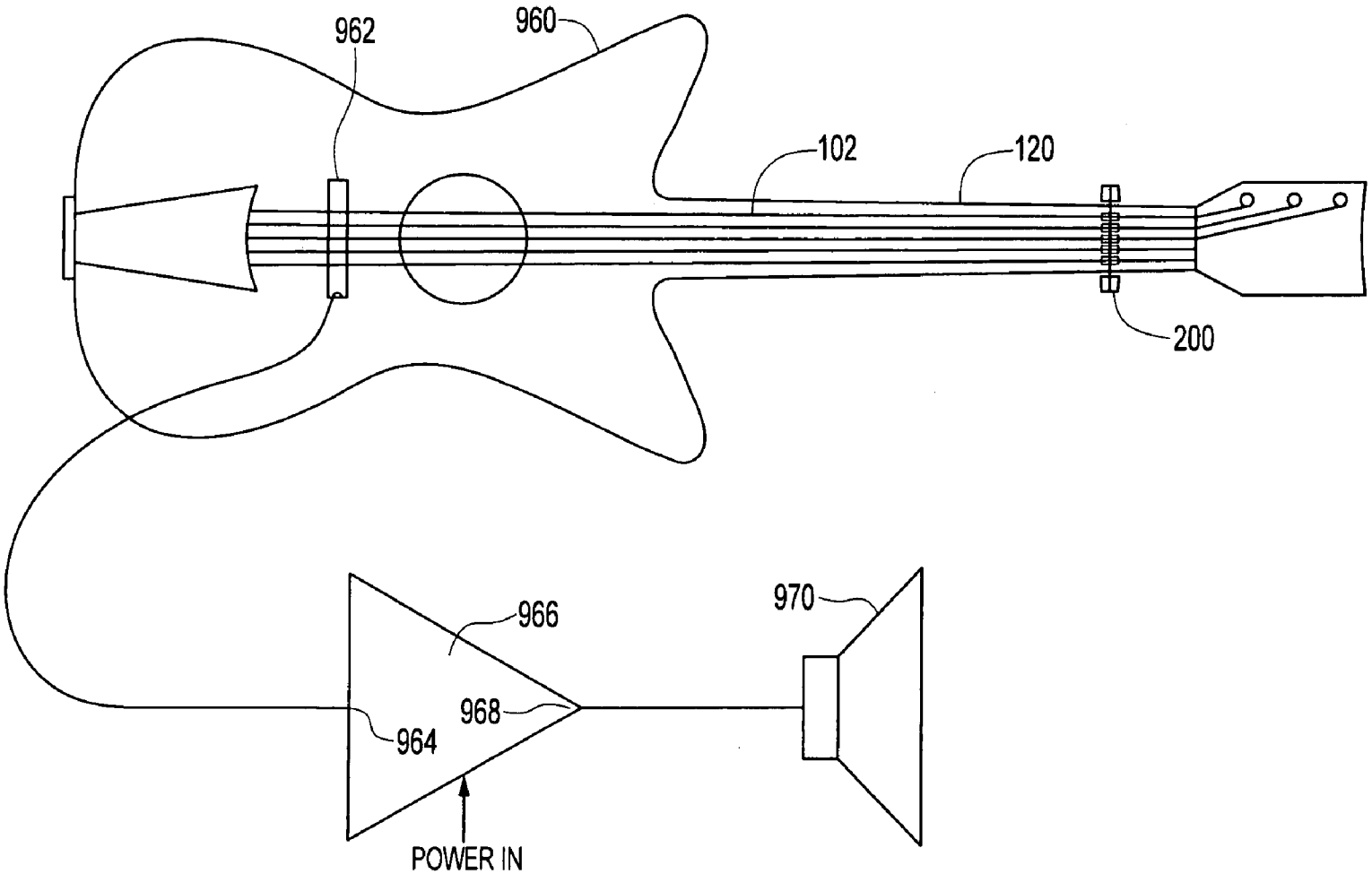
FIG. 16 shows a musical system according to one embodiment of the invention.

FIG. 16 shows a musical system according to one embodiment of the invention. The musical system includes a guitar 960 having a plurality of strings 102. The guitar also includes an electronic pickup 962 adapted to produce an electronic pickup signal.

The electronic pickup 962 is electrically coupled to an input port 964 of an electronic amplifier 966. An output port 968 of the electronic amplifier 966 is, in turn, coupled to an input of an electro-acoustic transducer such as a speaker 970. As would be understood by one of skill in the art, a further output of the amplifier 966 may be coupled to a recording device.

The guitar 960 also includes a neck 120. According to the invention, a capo 200 is mechanically coupled to the neck 120. The capo 200 is adapted to selectively depress one or more of the strings 102, thereby shortening an effective length of the selected strings and altering an open tuning of the musical system.

In a further embodiment, the invention includes a method of applying a capo to a stringed instrument including adjusting a gross width of the capo, placing the capo in proximity to a neck of the stringed instrument, performing a fine adjustment of a width of the capo such that a first jaw of the capo is urged toward a second jaw of the capo and toward the neck of the instrument disposed between the first and second jaws. By this action, the capo is temporarily and securely mechanically coupled to the neck of the stringed instrument. In one embodiment of the invention, one or more string contacting mechanisms are thereafter activated, so as to shorten a respective effective length of one or more corresponding strings. In another embodiment of the invention, one or more of the string contacting mechanisms are activated prior to securing the capo to the neck of the instrument.

In a further embodiment, the invention includes a method of manufacturing a capo that includes forming first and second capo jaw members, forming one or more string contacting members, coupling the one or more string contacting members to a shaft member, and supporting the shaft member between the two jaw members. The capo jaw members and string-contacting members may be formed according to any appropriate method as known in the art, including but not limited to casting, molding, machining, forging and sintering. An adjusting device is provided. The adjusting device is coupled to the shaft member and to one or more of the jaw members. The adjusting device is adapted to urge one of the jaw members towards the other of the jaw members by placing the shaft member in tension.

In a further embodiment, the invention includes manufacturing and packaging a plurality of support brackets in a respective plurality of sizes and also manufacturing and packaging a plurality of string contactor sets in a respective plurality of sizes. Accordingly, a particular capo and string contactor set may be selected and combined according to the dimensional requirements of a particular instrument. In addition, the invention includes a method of vending a capo including vending a supporting bracket in a first transaction and vending a plurality of string contractors in a second separate transaction.

While preferred embodiments of the invention have been described and illustrated above, it should be understood that these are exemplary of the invention and are not to be considered as limiting. Accordingly, the invention is not to be considered as limited by the foregoing description, but is only limited by the scope of the claims appended hereto.

The invention claimed is:

1. A capo comprising:

a first jaw;

a second jaw a first lateral member coupled between said first and second jaws a second lateral member disposed in substantially parallel spaced relation to said first lateral member;

a tensioning device coupled to said first lateral member and said first jaw;

a first string compressor disposed between and coupled to said first and second lateral members; and a second string compressor disposed between and coupled to said first and second lateral members, wherein said first and second string compressors are adapted to move independently of one another.

2. A capo as defined in claim 1 wherein said first and second string compressors are adapted to move linearly in a direction substantially perpendicular to a longitudinal axis of said first lateral member.

3. A capo as defined in claim 1 wherein said tensioning device comprises:

a threaded knob, said threaded knob being adapted to be threadingly coupled to a thread of said first lateral member.

4. A capo for a stringed instrument comprising:

a clamp, said clamp being adapted to grip a first side and a second side of a neck of a stringed instrument at respective concave surface regions of said clamp; and a plurality of string contactors supported by said clamp, said plurality of string contactors being adapted to independently urge a respective plurality of instrument strings toward a front surface of said neck, wherein each string contactor of said plurality of string contactors comprises a cam having a string contacting surf ace and a handle.

5. A capo as defined in claim 4 wherein said string contacting surface includes a groove adapted to partially receive said string therewithin.

6. A capo as defined in claim 4 wherein said clamp comprises:

a first jaw member;

a second jaw member;

a transverse member coupled to said first and second jaw members; and a tightener coupled to said transverse member, said tightener being adapted to draw said first jaw member towards said second jaw member so as to grip said neck when said neck is disposed between said first jaw member and second jaw member.

7. A capo as defined in claim 6 wherein said first jaw member includes a contacting surface adapted to contact said neck.

8. A capo as defined in claim 7 wherein said contacting surface includes a flexible material, said flexible material being adapted to conform to a shape of a portion of said guitar neck.

9. A capo as defined in claim 8 wherein said flexible material comprises a plastic material.

10. A capo as defined in claim 8 wherein said flexible material comprises a woven fiber material.

11. A capo as defined in claim 8 wherein said flexible material comprises a leather material.

12. A capo as defined in claim 8 wherein said flexible material comprises a rubber material.

13. A capo as defined in claim 8 wherein said flexible material comprises a leather material.

* * * * *